US005345887A

United States Patent [19]

Droste

[11] Patent Number: 5,345,887

[45] Date of Patent: Sep. 13, 1994

[54] THREAD MANIPULATIONS AT THE BEGINNING AND END OF A SEAM

[75] Inventor: Gunter Droste, Leopoldshohe, Fed. Rep. of Germany

[73] Assignee: Durkopp Adler Aktiengesellschaft, Fed. Rep. of Germany

[21] Appl. No.: 955,662

[22] Filed: Oct. 2, 1992

[30] Foreign Application Priority Data

Oct. 4, 1991 [DE] Fed. Rep. of Germany ..... 4132991

[51] Int. Cl.[5] ..... D05B 47/04; D05B 65/02

[52] U.S. Cl. ..... 112/255; 112/262.1; 112/291

[58] Field of Search ..... 112/224, 229, 243, 246, 112/250, 262.1, 273, 278, 291, 302, 255, 254, 258, 184, 292, 59, 97

[56] References Cited

U.S. PATENT DOCUMENTS

| | | | |
|---|---|---|---|
| 3,424,116 | 1/1969 | Von Hagen | 112/252 |
| 3,635,180 | 1/1972 | Conti | 112/252 |
| 3,982,491 | 9/1976 | Herzer et al. | 112/121 |
| 4,077,342 | 3/1978 | Steckenrider | 112/292 |
| 4,215,641 | 8/1980 | Dobrjanskyj et al. | 112/278 |
| 4,320,712 | 3/1982 | Johnson | 112/184 |
| 4,590,879 | 5/1986 | Matsubara et al. | 112/278 |
| 4,658,752 | 4/1987 | Keilmann et al. | 112/262.1 |
| 4,932,346 | 6/1990 | Matsubara et al. | 112/278 |
| 5,005,504 | 4/1991 | Alblrecht et al. | 112/291 X |
| 5,042,408 | 8/1991 | Suzuki et al. | 112/292 |
| 5,044,292 | 9/1991 | Nakamura et al. | 112/302 X |
| 5,078,068 | 1/1992 | Hager et al. | 112/262.1 |
| 5,105,750 | 4/1992 | Horie | 112/291 X |

FOREIGN PATENT DOCUMENTS

| | | | |
|---|---|---|---|
| 2743727 | 4/1978 | Fed. Rep. of Germany . | |
| 1100290 | 5/1986 | Japan | 112/302 |
| 2203895 | 8/1990 | Japan | 112/302 |
| 3146090 | 6/1991 | Japan | 112/302 |
| 4038992 | 2/1992 | Japan | 112/302 |

*Primary Examiner*—Clifford D. Crowder
*Assistant Examiner*—Ismael Izaguirre
*Attorney, Agent, or Firm*—Ostrolenk, Faber, Gerb & Soffen

[57] ABSTRACT

A thread-pulling device is fastened on the arm of a sewing machine. The thread-pulling device has a thread clamp that can be opened and closed on the thread, and can be moved toward and away from the sewing machine arm. In operation, the needle thread, which has been pulled off the spool and extends to the sewing needle, is conducted through the thread clamp. After an initial seam has been completed, the thread clamp is closed on the thread and moved to an extended position which is remote from the arm. In this way, a given length of the needle thread is pulled off the spool, thus providing the proper length of needle thread for dependable formation of the first stitch of the following seam. Then, shortly after the start of the following sewing process, the thread clamp is moved back over an intermediate distance toward the sewing machine arm so as to pull back the initial piece of the needle thread that is now hanging down from the back of the material at the start of the seam. The initial piece of needle thread is pulled back to such an extent that only a short piece of the needle thread, of predetermined length, will remain on the back of the material.

28 Claims, 4 Drawing Sheets

THREAD MANIPULATIONS AT THE BEGINNING AND END OF A SEAM

BACKGROUND OF THE INVENTION

The present invention relates to a method of producing a sewing seam, and more particularly to a method in which predetermined lengths of needle thread are provided at the sewing needle at the end of one sewing step and on the back of the sewing material at the beginning of the next sewing step.

German Patent 27 43 727 C3, which corresponds to U.S. Pat. No. 4,077,342, discloses a device for cutting the needle thread and bobbin thread in an automatic sewing machine. With the known device, on the one hand, short cut-off ends of the bobbin thread and the needle thread remain on the back of the sewn material after the threads are cut; while, on the other hand, sufficiently long initial lengths of bobbin thread and needle thread are provided for the next stitch. In particular, the initial piece of needle thread must be long enough so that, first of all, it does not come out of the eye of the sewing needle when the needle bar is moved to begin formation of the first stitch; and secondly, the end of the initial piece of needle thread is held in the sewing material by friction while the widened loop of needle thread is being moved around the looper until, finally, the formation of the first stitch is completed by knotting the needle thread to the bobbin thread.

The disadvantage of the procedure which has Just been described is that the sufficiently long initial piece of needle thread, which is required for the dependable formation of the first stitch, hangs down from the sewn material at the start of the seam. It must either be subsequently cut off (in the subsequent "cleaning" of the seam), or covered by the next stitch, or one of the next stitches, on the back of the material. When the needle thread is sewn in place in the above-mentioned manner, it forms an unattractive lump of thread which is frequently objectionable.

The subject matter of all prior art material referred to herein is expressly incorporated by reference.

SUMMARY OF THE INVENTION

The principal object of the present invention is therefore to provide a method of producing a seam which can assure that the start of the final seam will have a suitable appearance on the back of the material.

This object is achieved, according to an embodiment of the present invention, by a method of producing a sewing seam with short thread ends on the back of the sewn material, in which, after the needle thread is cut at the end of a first seam, the end of the needle thread hanging from the sewing needle, as well as the end of the bobbin thread hanging from the looper, both have a length which will permit the correct formation of the first stitch in the following sewing cycle.

According to a particularly advantageous feature of the invention, in the initial phase of forming a new seam, the needle thread hanging down from the needle after the previous seam is pulled back by a given length, so that only a short piece of thread of predetermined length still remains hanging through the back of the sewn material.

By this method, advantageously, in the initial phase of forming a seam, the needle thread, which has been pulled forward in order to properly form the stitch, is then pulled back by a well-defined length so that a short initial piece of needle thread remains on the back of the material. Another advantage of the method is that the protruding short initial piece can be given the proper length without an additional cutting process. In this way, the problem of thread scraps which can get into the looper or other sensitive devices below the sewing point is avoided.

According to another highly advantageous feature, a predetermined length of needle thread is withdrawn from the thread supply upon the completion of a seam, before the thread is cut. The advantageous result is that a precisely defined length of needle thread is withdrawn from the thread storage before the thread is cut, which dependably ensures the proper formation of the first stitch of the following seam.

Other features and advantages of the present invention will become apparent from the following description of an embodiment of the invention, which refers to the accompanying drawings.

DETAILED DESCRIPTION OF AN EMBODIMENT OF THE INVENTION

Figure 1:
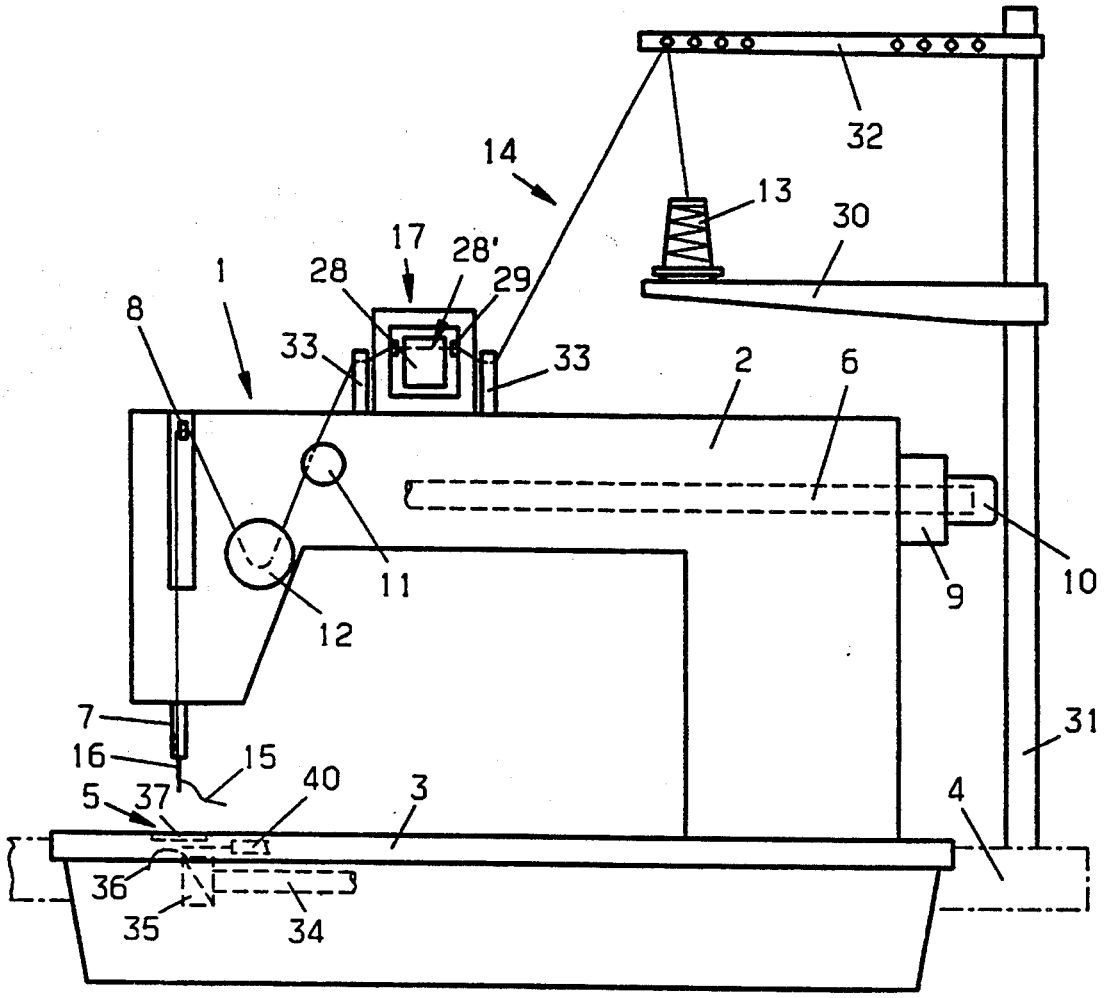
FIG. 1 is a simplified front view of a sewing machine with a thread-pulling device fastened to it.

FIG. 1 shows a sewing machine 1, which may be a double-lock-stitch, high-speed sewing machine, which includes an arm 2 and a base plate 3 bearing the arm. The base plate 3 is recessed in a table top 4 of a housing, not shown here. The sewing machine 1 is provided, on the bottom of the base plate 3, near a sewing point 5, with a conventional thread-cutting device 40 which is well known and which will not be described in detail here.

Within the arm 2 is an arm shaft 6 which, among other functions, drives an upwardly and downwardly movable needle bar 7 as well as a thread lever 8 which, as is known, carries out a substantially upward and downward movement over a curved path. On the outside of the arm 2, on the arm shaft 6, there is a hand wheel 9 as well as a position indicator 10. The latter, in known manner, permits the positioning of the needle bar 7 in its raised position, which is necessary in order to cut the thread.

On the arm 2, as shown in FIG. 1, is a first thread-tensioning device 11 for applying a very slight, invariable thread-tensioning force. A second thread-tensioning device 12, has a released position and an active position. In the released position during the thread-cutting process, it is inactive, and in the active position it performs a braking function which is adjustable. A needle thread 14 is withdrawn from an external supply of thread, namely a spool 13. The braking actions exerted by the two thread-tensioning devices 11, 12 impart a tensioning force to the needle thread which is adapted to the particular sewing process being carried out.

The first tensioning device 11 has two main functions. First of all, during the thread-cutting process, when the second thread-tensioning device 12 is released, it assures that the following needle thread 14 to be cut will be dependably caught by a thread catcher of the thread cutting device, 40 by tensioning the thread slightly so as to straighten it, as known, for example, from U.S. Pat. No. 3,635,180, incorporating by reference.

Secondly, it serves to control the length of an initial piece of thread 15 which hangs out of the eye of the sewing needle 16 after the thread is cut. The sewing needle, as is known, is taken up and guided by the needle bar 7.

Figure 2:
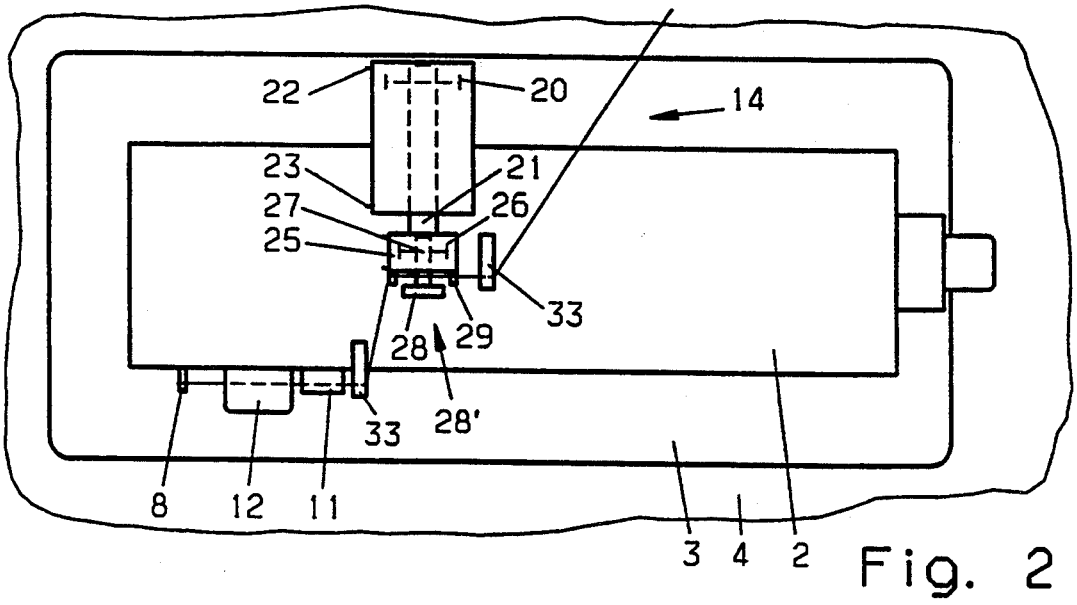
FIG. 2 is a simplified top view of the sewing machine with the thread-pulling device fastened to it.
Figure 3:
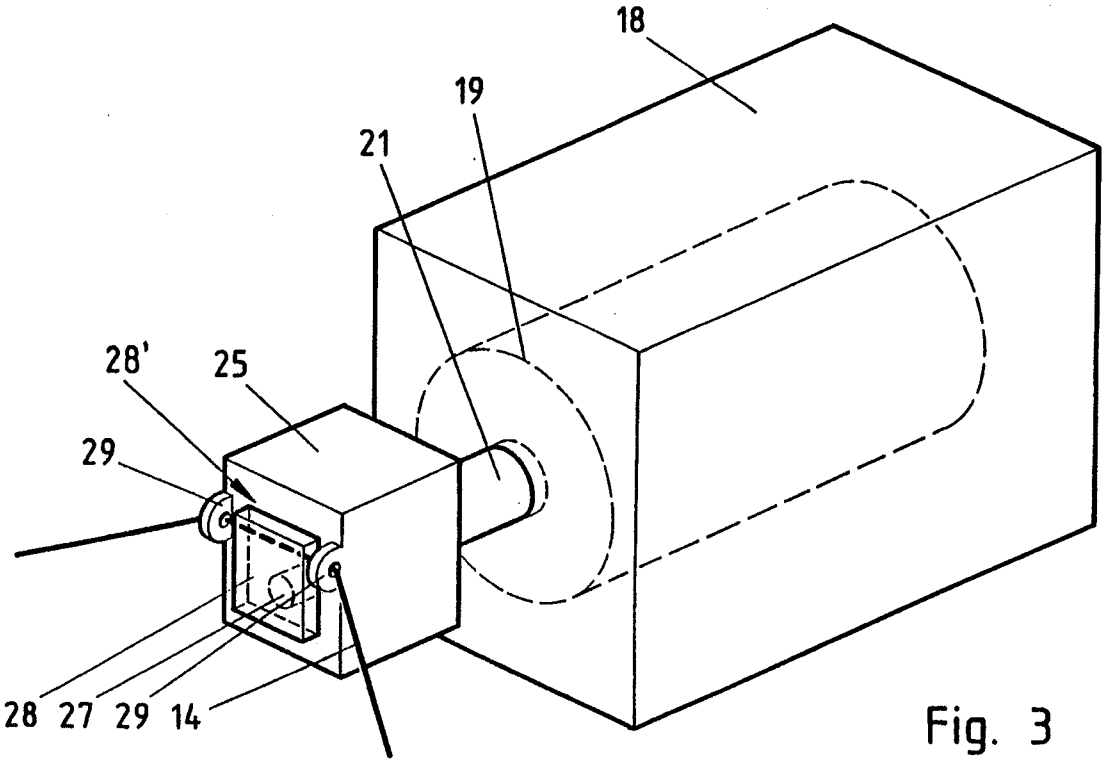
FIG. 3 is a perspective view of the thread-pulling device.
Figure 4:
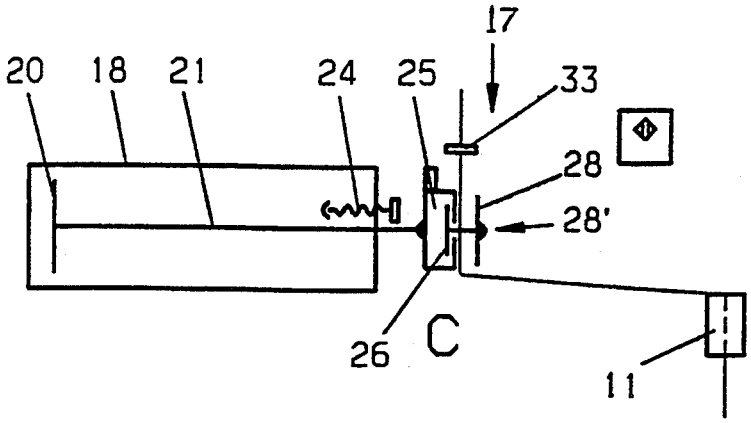
FIGS. 4–10 are diagrammatic views of the thread-pulling device in different functional positions.

On the top of the arm 2, as shown in FIGS. 1 and 2, is fastened a thread-pulling device 17, the construction of which can be noted in detail from FIG. 3. A block 18 has, within it, a cylindrical bore 19 which, as indicated in FIG. 2, is closed at the rear by a cover. In this way, the block 18 forms the cylinder tube of a cylinder which can be actuated by a pressure fluid, preferably a compressed-air cylinder. The bore 19 receives a piston 20, which is indicated in FIG. 2, on which there is fastened a piston rod 21 which, as shown in FIGS. 2 and 3, passes through the front of the block 18. The piston rod 21 is mounted in the block 18, secured against rotation, in a suitable manner known to the person skilled in the art.

The working cylinder shown in FIG. 2 has the form of a double-acting cylinder, but it could also be a single-acting cylinder. As shown schematically in FIG. 2, a first passage 22 and a second passage 23 are provided in the block 18 and permit the entrance and discharge of the pressure fluid in either direction.

As shown diagrammatically FIGS. 4 to 10, an adjustable stop 24 is provided on the front side of the block 18. As beet seen in FIGS. 6 and 7, the stop limits the stroke of the piston 20 and the outward movement of the piston rod 21.

As shown in FIGS. 2 and 3, a second block 25 is fastened on the free end of the piston rod 21. Like the block 18, the second block 25 is a double-acting work cylinder, but with a very small piston stroke. In line with this, it receives within it a piston 26 which is connected to a second piston rod 27. On its free end, the latter has a clamping plate 28, which thus extends parallel to the front of the block 25. Together with the front side of the block 25, the clamping plate 28 forms a thread clamp 28', as shown in FIGS. 2 and 3.

In the immediate vicinity of the clamping plate 28, two thread-guide eyes 29 are provided, as shown in FIGS. 1 to 3, on the front of the block 25. The eyes 29 dependably guide the needle thread 14 on its path to the sewing needle 16, as it passes between the front of the block 25 and the facing side of the clamping plate 28.

The spool 13 is supported as shown in FIG. 1 by a thread-spool carrier 30. The latter is fastened on a tubular stand 31 which is mounted on the table top 4. Above the thread-spool carrier 30, a thread-guide arm 32 is furthermore fastened on the tubular stand 31. This arm serves, in known manner, to quiet the needle thread 14 which is withdrawn from the spool 13, by damping and absorbing vibrations.

On the top of the arm 2 there are two thread guides 33, each thread guide 33 having a thread-guide hole. The edges of the thread-guide holes are rounded and polished so as to be present a smooth surface for the thread, as are the edges of the corresponding thread-guide holes in the thread-guide eyes 29.

As shown in FIG. 1, the needle thread 14 withdrawn from the spool 13 passes sequentially through the first thread guide 33, the two thread-guide eyes 29, the second thread guide 33, the first thread-tensioning device 11, the second thread-tensioning device 12, the thread lever 8 and the eye of the sewing needle 16. In order to simplify the description, all well-known parts which also participate in the above-described course of the thread, such as the thread-pulling spring on the thread-tensioning device and various other thread-guide eyes, have not been mentioned here and also are not shown in the drawings.

In the base plate 3 there is mounted, in known manner, a looper shaft 34 which, via a drive means not shown here, for instance a toothed belt, is driven by the arm shaft 6. On the free end of the looper shaft 34, below the sewing point 5, there is a rotating looper 35 which, in combination with the sewing needle 16 and a feed dog (not shown here), permits the formation of stitches in known manner. After the thread is cut, one end of the bobbin thread 36 hangs out of the looper 35, as shown in FIG. 1. As is known, a throat plate 37 is provided in the baseplate 3 near the sewing point 5.

The method of operation of the disclosed embodiment of the invention will now be described.

The needle thread 14 which has been withdrawn from the spool 13 and extends to the sewing needle 16 is conducted through the thread clamp 28', as shown in FIGS. 1 to 3. In this connection, the thread-guide eyes 29 which guide the needle thread assure that the needle thread 14 passing through them will have a well-defined position.

At the end of an initial seam, the thread is cut. By way of preparation for the cutting step, the cutting knife is first of all brought into a gripping position, in which the needle thread 14 which is to be cut off is grasped by a gripping hook on the cutting knife. Such a thread-cutting device, 40 particularly the cutting knife and its drive elements, is well known, for example for U.S. Pat. No. 3,635,180, so for reasons of simplicity, it need not be further described or shown here.

Figure 5:
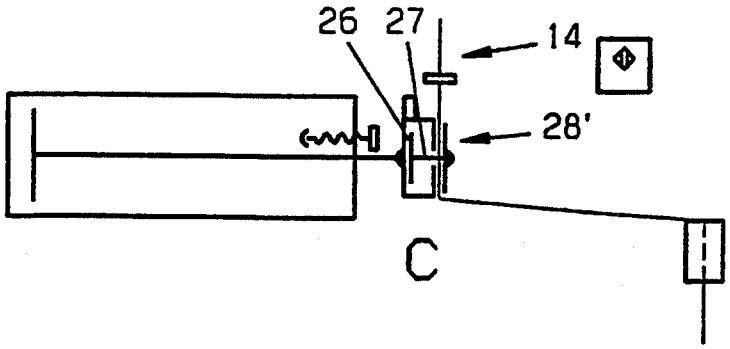
Figure 6:
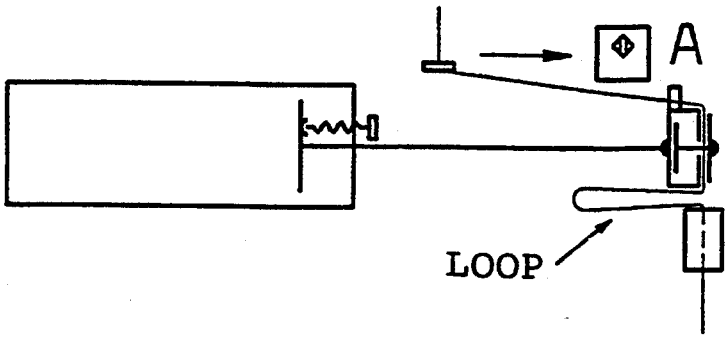
Figure 7:
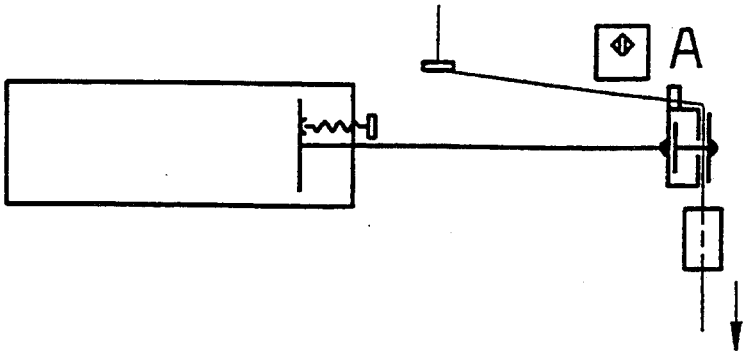

Simultaneously with the above-mentioned preparation for cutting the thread, the thread clamp 28' is closed, as shown in FIG. 5, whereby the part of the needle thread 14 which is present at the time in the thread clamp 28' is clamped between the front side of the block 25 and the facing side of the clamping plate 28. The thread clamp 28' may be closed by suitably applying pressure fluid to the block 25, which as mentioned above is a double-acting work cylinder in this embodiment. Alternatively, the thread clamp 28' could also be closed by mechanical means, for instance by an over-center mechanism, which is well-known in connection with gears. It would also be possible for the parts that provide pressure cylinders, namely blocks 18 and 25, to instead be developed as solenoids, in order to permit electromagnetic actuation of the thread clamp 28'.

After the thread clamp 28' is closed, compressed air is introduced via the passage 22 into the cylindrical bore 19 of the block 18. The piston 20 is thus advanced, in accordance with FIG. 6, until it comes against the adjustable stop 24. In this way, the thread clamp 28' is brought out of its retracted position C (starting position) into its extended position A. In this way, since the thread-tensioning devices 11, 12 are in their closed positions, the closed thread clamp 28' pulls out a given length of needle thread (hereinafter referred to as "the pulled-out thread") from the spool 13 (see FIG. 6). On the other hand, a loop is formed in the needle thread 14 between the thread clamp 28' and the thread-tensioning device 11. This loop of thread is thus made available for use during the cutting of the thread which is next to be carried out.

Then, in the thread-cutting process, this loop of thread can be pulled off easily by the thread-cutting device, 40 since the thread-tensioning device 12 is released and since the needle thread 14 need no longer pass through the thread-pulling device 17. Thus, the formation of the loop assists the subsequent cutting process, by reducing the force required for the thread catcher to pull off the needle thread for cutting. The action of the thread-pulling device 17 prior to the thread-cutting process provides constant conditions for the formation of the initial piece of thread 15 (FIG. 1) for forming initial stitches having a better appearance during the subsequent sewing process.

The length of the pulled-out needle thread is dependent on the commencement of the action of the compressed air on the block 18 and on the setting of the stop 24.

When the needle thread 14, which has been previously intercepted, is cut off, the above-mentioned pulled-out length of needle thread is thereby pulled downward, below the throat plate 37. See FIG. 7. Thus, the above-described step of pulling-out a given length of needle thread from the spool 13 assures that at all times an initial piece 15 of the same length will hang out of the eye of the sewing needle 16, as shown in FIG. 1, which shows the sewing machine in condition for beginning a new stitching process.

Figure 8:
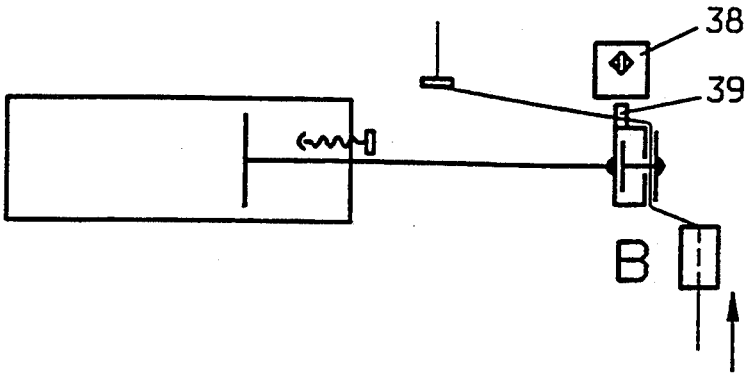

In order to begin the production of a subsequent seam, and therefore at the start of the next sewing cycle, the arm shaft 6 of the sewing machine i is placed in rotation, which causes movement of the needle bar 7 and the thread lever 8 in known manner. At the start of the sewing process, during a period of time from the start of the rotation of the arm shaft 6 until completion of the initial revolutions, for example until completion of the fourth revolution of the arm shaft 6, the thread clamp 28', which continues to hold the needle thread 14 clamped fast, is moved over an adjustable distance starting from the extended position A into an intermediate position B (FIG. 8). The times for the start and end of the movement of the thread clamp 28' from position A to position B are within the limits of the previously defined initial (e.g. four-revolution) period of time, and are determined by parameters specific to the sewing, for instance the thickness and nature of the material sewn, the thickness and nature of the sewing thread, the course of movement of the thread lever 8 relative to the course of movement of the needle bar 7, the shape of the eye in the sewing needle 16, and other parameters.

In order to move the closed thread clamp 28' from the extended position A in the direction toward the intermediate position B at the start of the next sewing cycle at the proper time, as shown in FIG. 8, compressed air is fed via the second passage 23 into the bore 19 of the block 18, as a result of which the piston 20 leaves its end position, which was defined as being limited by the stop 24. As a result of the movement of the piston 20 which has just been described, the thread clamp 28', which is still closed, is moved, starting from its extended position A, in the direction toward its retracted position C, whereby the thread clamp 28' passes through the intermediate position B. Since the thread-tensioning device 12 is now in its released, opened position, the needle thread 14 which was pulled forward is now pulled back by a given length (see FIG. 8) which provides assurance that at the start of the seam which has just been started, only a short piece of the needle thread 14, having a predetermined length, remains.

When the intermediate position B is reached, the thread clamp 28' is opened by a corresponding action of compressed air on the block 25 (FIG. 9) and as the sewing continues, the required quantity of sewing thread is drawn, unimpeded, from the spool 13, since the closed, i.e. active, thread-tensioning devices 11, 12 prevent any further pulling back of the needle thread 14.

Figure 9:
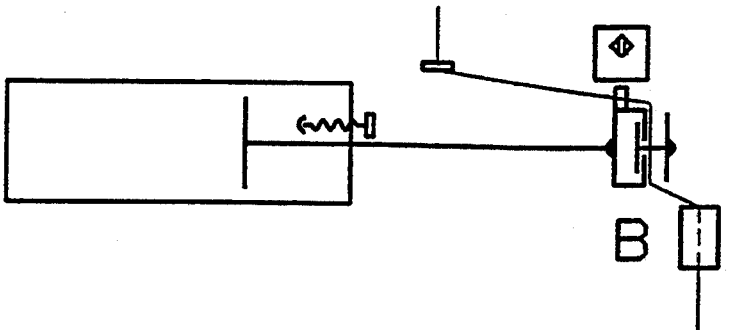
Figure 10:
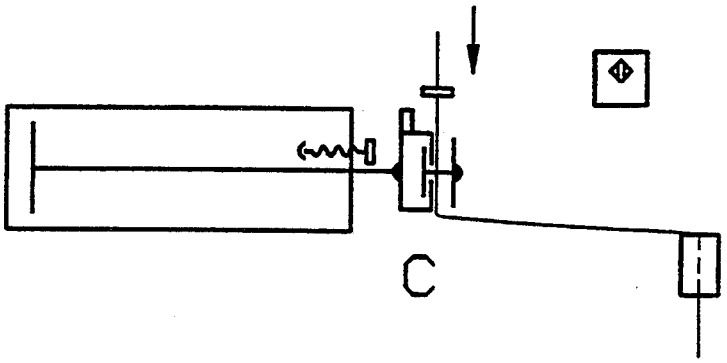

The application of compressed air to the block 25 at the proper time, to open or close the thread clamp 28', is controlled by an approach-sensitive device 38 (see FIGS. 8 and 9). The thread clamp 28' is opened or closed when a lug 39 provided on the block 25 comes into the sensing field of the device 38. The device 38 may be a contactless switch which acts capacitively or inductively, for example. The device 38 is arranged for adjustable manual displacement parallel to the direction of movement of the thread clamp 28', for instance on the thread-pulling device 17. Because the opening of the thread clamp 28' is distance-dependent, the pulling back of the needle thread 14 is adjustable, so that a predetermined given length of the needle thread 14 which has been pulled forward, will protrude through the back of the material at the start of the seam.

After the above-described opening of the thread clamp 28', the sewing process, which may have been started with a so-called soft start (with low initial speed of rotation), or may have been briefly interrupted, is continued, and the thread clamp 28' is brought into its retracted position C. The opened thread clamp 28' remains in this position until the thread-cutting process is brought about in the manner described above at the end of the seam.

The start and duration of the application of pressure fluid to the bore 19 of the block 18, or another means of providing movement of the thread clamp 28' from C to A, or from A via B to C, is controlled by a conventional control which is not shown here because it is known to skilled persons. By means of ordinary commercial pneumatic parts such as throttle valves and solenoids, which have also not been shown here, compressed air may be introduced via the connections 22 and 23 into the block 18, as already described above, from an external source of compressed air.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A method of producing a sewing seam with an attractive appearance, comprising the steps of:

cutting a needle thread and a bobbin thread at the end of a previous first seam such that a trailing end portion of the needle thread hangs out from a sewing needle, and then forming a subsequent second seam in a material to be sewn, wherein in an initial phase of forming the subsequent second seam, said trailing end portion of the needle thread is located so as to hang from an underside of the material and is provided with a first predetermined length by pulling the needle thread back from said material, so that only a short piece of needle thread having said first predetermined length remains on the underside of the material when said second seam is produced, thereby producing a sewing seam with an attractive appearance.

2. A method according to claim 1, further comprising the step of providing a second predetermined length of the needle thread upon the completion of the previous first seam and before the cutting of the needle thread.

3. A method according to claim 2, further comprising the steps of:

a) conducting the needle thread from a spool to the sewing needle through a thread clamp which is provided on a stationary thread-pulling device, the thread clamp being operable and closable and being variable in position transversely of the needle thread;

b) at the end of forming the previous first seam and simultaneously with preparation for the cutting of the needle tread, closing the thread clamp, and at the beginning of cutting of the needle thread, bringing the thread clamp into an extended position in a direction transverse to the needle thread, such that said second predetermined length of needle thread is made available for the cutting of the needle thread;

c) upon the cutting of the needle thread, the length of needle thread which has been made available is pulled downward past the bottom of a throat plate, as a result of which, after the cutting of the needle thread, said trailing end portion of the needle thread hangs out of the sewing needle;

d) during a beginning phase of the second seam to be produced, moving the thread clamp which holds the needle thread transversely in a direction opposite to its previous direction of movement into an intermediate position, thus pulling back the needle thread from the material at the start of the second seam so that said first predetermined length of said trailing end portion of the needle thread remains on the underside of the material;

e) upon reaching the intermediate position, the thread clamp is opened; and f) during the sewing of the following stitches of the second seam, the thread clamp is returned from the intermediate position into its retracted position.

4. A method according to claim 3, wherein said intermediate position is adjustable.

5. A method according to claim 3, wherein the opening and closing of the thread clamp as well as the extension and retraction of the thread clamp are effected by means actuatable by pressure fluid.

6. A method according to claim 5, wherein said means are actuatable by compressed air.

7. A method according to claim 1, wherein a trailing end portion of a bobbin thread hangs out from a looper, said trailing end portions of the needle thread and the bobbin thread being provided for the formation of a first stitch of said subsequent second seam.

8. A device in a sewing machine for producing a sewing seam with an attractive appearance, comprising:

a first device for cutting a needle thread and a bobbin thread in said sewing machine at the end of a previous first seam such that, after cutting, a trailing end portion of the needle thread hangs out from a sewing needle, said trailing end portion of the needle thread being provided for the formation of a subsequent second seam; and a second device for providing said trailing end portion of the needle thread, located so as to hang from an underside of a material to be sewn, with a first predetermined length, by pulling the needle thread back from the material so that only a piece of needle thread having said first predetermined length remains on the underside of the material when said subsequent second seam is produced in said material, thereby producing a sewing seam with an attractive appearance.

9. A device according to claim 8, further comprising a third device for withdrawing a defined length of the needle thread from a thread supply of said sewing machine upon the completion of the previous first seam and before the cutting of the needle thread.

10. A device according to claim 9, further comprising:

a) means for conducting the needle thread from a spool to the sewing needle; and b) a thread clamp which is provided on a stationary thread-pulling device on said sewing machine, the needle thread being conducted through said thread clamp, the thread clamp being openable and closable and being variable in position transversely of the needle thread.

11. A device according to claim 10, wherein the thread clamp is closable at the end of forming the previous first seam and simultaneously with preparation for the cutting of the thread, and is movable at the beginning of cutting of the thread, into an extended position in a direction transverse to the needle thread, such that a second predetermined length of needle thread is withdrawn from the spool and is made available for the cutting of the thread.

12. A device according to claim 11, wherein, upon the cutting of the thread, the sewing machine is operable to pull the length of needle thread which has been made available, downward past the bottom of a throat plate, such that after the cutting of the thread, said trailing end portion of the needle thread hangs out of the sewing needle.

13. A device according to claim 12, wherein the thread clamp is movable, with the needle thread, at the start of forming the second seam, transversely in a direction opposite to its previous direction of movement into an intermediate position, thus pulling back the needle thread from the material at the start of the second seam so that said first predetermined length remains on the underside of the material.

14. A device according to claim 13, wherein said movement into said intermediate position takes place within a period of time Just after the start of rotation of an arm shaft of said sewing machine.

15. A device according to claim 8, wherein after cutting, a trailing end portion of a bobbin thread hangs out from a looper, said trailing end portions of the needle thread and the bobbin thread being provided for the formation of a first stitch of said subsequent second seam.

16. A method of producing a sewing seam with an attractive appearance, comprising the steps of:

cutting a needle thread and a bobbin thread at the end of a previous first seam such that a trailing end portion of the needle thread hangs out from a sewing needle, and a trailing end portion of a bobbin thread hangs out from a looper, both end portions being provided for the formation of a subsequent first stitch; and forming a subsequent second seam in a material to be sewn, wherein in an initial phase of forming the subsequent second seam, said trailing end portion of the needle thread is located so as to hang from an underside of the material and is provided with a first predetermined length by pulling the needle thread back from said material, so that only a short piece of needle thread having said first predetermined length remains on the underside of the material when said second seam is produced, thereby producing a sewing seam with an attractive appearance.

17. A method according to claim 16, further comprising the step of providing a second predetermined length of the needle thread upon the completion of the previous first seam and before the cutting of the needle thread.

18. A method according to claim 17, further comprising the steps of:

a) conducting the needle thread from a spool to the sewing needle through a thread clamp which is provided on a stationary thread-pulling device, the thread clamp being openable and closable and being variable in position transversely of the needle thread;

b) at the end of forming the previous first seam and simultaneously with preparation for the cutting of the needle thread, closing the thread clamp, and at the beginning of the needle thread, closing the thread clamp, and at the beginning of cutting of the needle thread, bringing the thread clamp into an extended position in a direction transverse to the needle thread, such that said second predetermined length of needle thread is made available for the cutting of the needle thread;

c) upon the cutting of the needle thread, the length of needle thread which has been made available is pulled downward pas the bottom of a throat plate, as a result of which, after the cutting of the needle thread, said trailing end portion of the needle thread hangs out of the sewing needle;

d) during a beginning phase of the second seam to be produced, moving the thread clamp which holds the needle thread transversely in a direction opposite to its previous direction of movement into an intermediate position, thus pulling back the needle thread from the material at the start of the second seam so that said first predetermined length of said trailing end portion of the needle thread remains on the underside of the material;

e) upon reaching the intermediate position, the thread clamp is opened; and f) during the sewing of the following stitches of the second seam, the thread clamp is returned from the intermediate position into its retracted position.

19. A method according to claim 18, wherein said intermediate position is adjustable.

20. A method according to claim 18, wherein the opening and closing of the thread clamp as well as the extension and retraction of the thread clamp are effected by means actuatable by pressure fluid.

21. A method according to claim 20, wherein said means are actuatable by compressed air.

22. A device in a sewing machine for producing a sewing seam with an attractive appearance, comprising:

a first device for cutting a needle thread and a bobbin thread in said sewing machine at the end of a previous first seam such that, after cutting, a trailing end portion of the needle thread hangs out of a sewing needle and a trailing end portion of a bobbin thread hangs out from a looper, both end portions being provided for the formation of a subsequent first stitch; and a second device for providing said trailing end portion of the needle thread, located so as to hang from an underside of a material to be sewn, with a first predetermined length, by pulling the needle thread back from the material so that only a piece of needle thread having said first predetermined length remains on the underside of the material when said subsequent second seam is produced in said material, thereby producing a sewing seam with an attractive appearance.

23. A device according to claim 22, further comprising a third device for withdrawing a defined length of the needle thread from a thread supply of said sewing machine upon the completion of the previous first seam and before the cutting of the needle thread.

24. A device according to claim 23, further comprising:

a) means for conducting the needle thread from a spool to the sewing needle; and b) a thread clamp which is provided on a stationary thread-pulling device on said sewing machine, the needle thread being conducted through said thread clamp, the thread clamp being openable and closable and being variable in position transversely of the needle thread.

25. A device according to claim 24, wherein the thread clamp is closable at the end of forming the previous first seam and simultaneously with preparation for the cutting of the thread, and is movable at the beginning of cutting of the thread, into an extended position in a direction transverse to the needle thread, such that a second predetermined length of needle thread is withdrawn from the spool and is made available for the cutting of the thread.

26. A device according to claim 25, wherein, upon the cutting of the thread, the sewing machine is operable to pull the length of needle thread which has been made available, downward past the bottom of a throat plate, such that, after the cutting of the thread, said trailing end portion of the needle thread hangs out of the sewing needle.

27. A device according to claim 26, wherein the thread clamp is movable, with the needle thread, at the start of forming the second seam, transversely in a direction opposite to its previous direction of movement into an intermediate position, thus pulling back the needle thread from the material at the start of the second seam so that said first predetermined length remains on the underside of the material.

28. A device according to claim 27, wherein said movement into said intermediate position takes place within a period of time just after the start of rotation of an arm shaft of said sewing machine.

* * * * *